United States Patent [19]

Brul et al.

[11] 4,249,485

[45] Feb. 10, 1981

[54] FEED WATER PREHEATER

[75] Inventors: Jakob Brul, Nussbaumen; Helena Riegger, Zurich, both of Switzerland

[73] Assignee: BBC Brown Boveri & Company Limited, Baden, Switzerland

[21] Appl. No.: 37,510

[22] Filed: May 9, 1979

[30] Foreign Application Priority Data

May 31, 1978 [CH] Switzerland ..... 5941/78

[51] Int. Cl.[3] ..... F22D 1/28

[52] U.S. Cl. ..... 122/441; 165/112; 165/113

[58] Field of Search ..... 122/441, 1 C, 442, 443; 165/110, 111, 112, 113, 114

[56] References Cited

U.S. PATENT DOCUMENTS

| | | | |
|---|---|---|---|
| 958,845 | 5/1910 | White | 122/443 |
| 2,995,341 | 8/1961 | Danesi | 165/113 |
| 3,020,024 | 2/1962 | Lawrance | 165/113 |
| 3,795,273 | 3/1974 | Brigida | 165/112 |
| 3,938,588 | 2/1976 | Coit et al. | 165/113 |

*Primary Examiner*—Edward G. Favors

*Attorney, Agent, or Firm*—Burns, Doane, Swecker & Mathis

[57] ABSTRACT

A feed water preheater is disclosed having warm and cold tube bundles. The warm tube bundle is divided into first and second warm tube bundles with the first warm tube bundle forming a desuperheater bundle and the second warm tube bundle forming a condenser bundle. The first and second warm tube bundles are isolated with respect to one another with a steam distribution duct arranged between the warm and the cold tube bundles. Preferably, the warm and cold tube bundles are U-shaped with a steam inlet arranged perpendicularly with respect to the tube bundles.

8 Claims, 2 Drawing Figures

I-I

FEED WATER PREHEATER

BACKGROUND AND SUMMARY OF THE PRESENT INVENTION

The present invention relates generally to a feed water preheater.

When superheated steam is introduced into a feed water preheater, in particular into a condensing preheater, part of the superheat can be thermodynamically utilized in a desuperheater, if the steam is sufficiently superheated. The steam is introduced through a branch, pointing towards the tube bundles, into the desuperheater and is passed in a counter-current manner around the tube bundles. The steam accordingly heats up the feed water flowing in the tubes, with the heating taking place by convection. After flowing through the desuperheater, the steam passes into the condensing part of the preheater, where the steam is precipitated.

In feed water preheaters, the steam pressure in the condensing part of the preheater is substantially lower than at the inlet of the desuperheater, because of the flow losses which the steam incurs while passing through the desuperheater until the steam leaves the latter.

In known feed water preheaters, for example as described in German Offenlegungsschrift No. 2,441,324, annular gaps are present between the isolating support plate of the desuperheater and the preheater tubes, where the tubes pass through. The steam can thereby escape through these gaps into the condensing zone, outside of the intended outlet of the desuperheater, or from a steam distribution duct.

In vertical preheaters having an upward steam flow, a layer of condensate is present on the isolating support plate of the desuperheater. Especially in the case of large preheaters, the velocity of the steam through the annular gap can be very high so that droplets of water are carried over from the layer of condensate and are thrown against the tube walls. This water can cause damage by mechanical ablation of material as well as by erosion and by corrosion which can result in the destruction of the tubes.

It is accordingly a primary object of the present invention to provide a feed water preheater in which the pressure difference upstream and downstream of the isolating baffle plate of the desuperheater is reduced and in which the utilization of the steam temperature can be optimized without damage to the plant occuring in the desuperheater.

According to the invention, the abovementioned object is achieved when the warm tube bundle part is divided into at least two part bundles, namely a desuperheater bundle and a condenser bundle and a condensate drain channel is located between the two part bundles.

It is also advantageous to arrange the cross-sections, which are exposed to the steam, of the two part bundles approximately equally. This arrangement results in the advantage that, for example in the layout of feed water preheaters, a standardization of the tube bundles becomes possible.

Depending on the size and capacity of the preheater, however, it can also be advisable for the two part bundles to have cross-sections which are variable relative to one another.

This second arrangement will prove advantageous wherever high steam velocities occur. With such an arrangement, a lower steam rate is then passed through the desuperheater part bundles and a higher steam rate is passed through the condenser part bundle.

According to another preferred embodiment, collection pockets for taking away the condensate from the warm part bundles can be provided between the condensate drain channels and the radial baffle plates.

A particular advantage of the arrangement according to the invention is above all to be seen in the fact that, due to the division of the warm tube bundle part into two part bundles (specifically into an inner part bundle and an outer part bundle), a reduction of the pressure difference upstream and downstream of the support plate of the desuperheater and hence a reduction of the flow velocity through the annular gap are achieved in spite of a relatively high cross-flow velocity of the steam in the desuperheater. At the same time, the steam can leave the desuperheater at a point with favorable flow conditions and enter the central steam distribution duct at that point. As a result of the provision of at least one, but preferably two steam inlets opposite one another which (in particular in the case of U-shaped tube bundles) are arranged perpendicular to the plane of the U-arms, the steam can be passed into the preheater where there are no tubes so that the steam first fills this space and only then flows around the tubes in the desuperheater at a uniform and permissible velocity. In this way, in addition to the prevention of damage, it is also impossible for vibrations to occur.

The fitting of condensate drain channels enables the condensate which forms both on the baffle plates above the desuperheater and also on the isolating support plate to run off. As a result, the heating surface area which would be inactivated by stagnant condensate is available again for the preheating process. Furthermore, a mutual impact of steam and condensate is prevented, and no droplets of water are thus carried over by the steam flow.

BRIEF DESCRIPTION OF THE DRAWINGS

A preferred embodiment of apparatus according to the present invention is described with reference to the accompanying drawings wherein like members bear like reference numerals and wherein.

DETAILED DESCRIPTION OF THE PREFERRED EMBODIMENT

Figure 1:
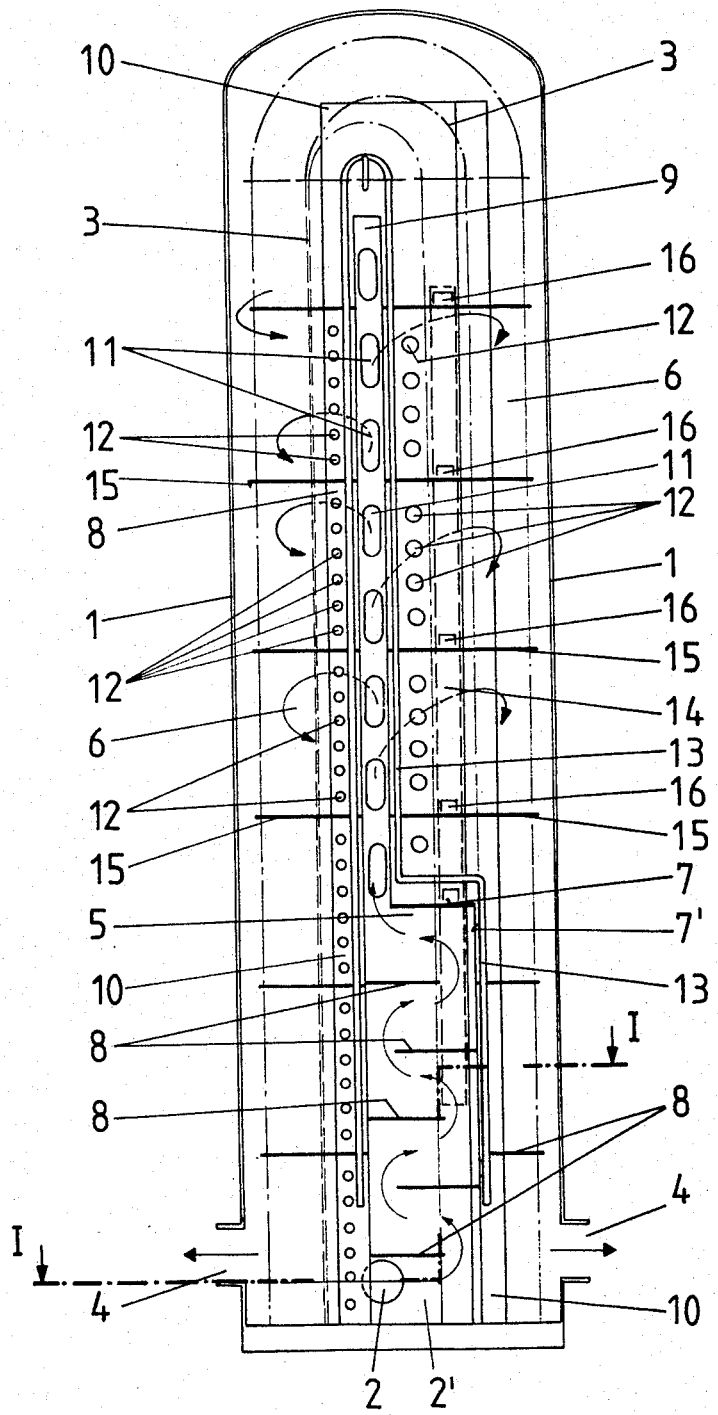
FIG. 1 is a longitudinal view in partial cross-section of a feed water preheater according to the present invention.

With reference now to FIG. 1, a preferred embodiment of an apparatus according to the present invention includes a feed water preheater having an outer shell 1. At least one steam inlet 2 is arranged at the lower end of the outer shell in such a way that the inlet 2 is provided perpendicular to the plane of U-arms of tube bundles 3 of U-shaped design. For clarity's sake the U-arms of tube bundles 3 are only indicated in the figure.

After flowing through the steam inlet 2, the steam first passes into a tube-free zone 2' in the feed water preheater. Condensate outlet openings 4 are likewise provided at the lower end of the outer shell 1.

In the lower part of the feed water preheater, a desuperheater 5 is located, which desuperheater is isolated from a condensation space 6 both by an isolating support plate 7 and by a wall plate 7'. Steam baffles 8, around which the steam flows in the direction of the arrows, are located in the interior of the desuperheater 5. A steam distribution duct 9, having cover plates 10 and steam outlet openings 11 which open into the condensation space 6, leads to the isolating support plate 7.

The cover plates 10 also have steam-charge openings 12, through which the steam flow is passed uniformly into the tube bundles 3. Moreover, a vent pipe 13 and condensate drain channels 14 are provided in the condensation space 6. Baffle plates 15 are located between the tube bundles 3 in the condensation space 6. The points where the condensate drain channels 14 pass through the cover plates 10 are arranged as collection pockets 16.

Figure 2:
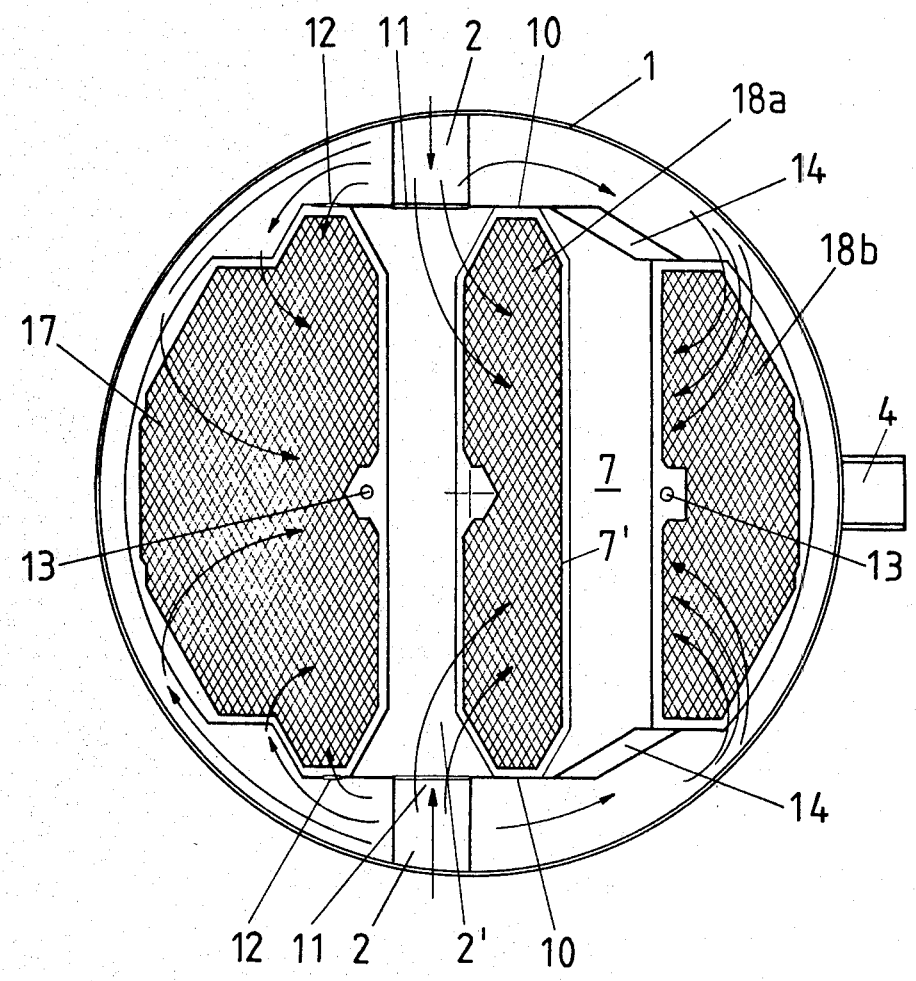
FIG. 2 is a view through the line I—I of FIG. 1.

With reference now to FIG. 2, the outer shell 1 again surrounds the tube bundles 3 which are divided into a cold tube bundle part 17 and a warm tube bundle part. The warm tube bundle part is further divided into two part bundles 18*a* and 18*b*. Of the two part bundles 18*a* and 18*b*, the inner part bundle 18*a* is the desuperheater and the outer part bundle 18*b* is the condenser. The condesate drain channels 14 run between the two part bundles 18*a* and 18*b* in the longitudinal direction of the feed water preheater. The vent pipes 13 are arranged both on the cold tube bundle part 17 and between the two warm tube bundle parts 18*a* and 18*b*.

Corresponding to the capacity of the preheater, the cross-sections of the two warm tube bundle parts 18*a*, 18*b* can either be equal or they can be variable relative to one another. Furthermore, the tube bundle part 18*a* serving as the desuperheater can have an approximately rectangular cross-section.

With reference again to FIGS. 1 and 2, the direction of steam flow is indicated by curved arrows, and the direction of draining of the condensate is indicated in FIG. 1 by straight arrows.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A feed water preheater, comprising:

a warm tube bundle;

a cold tube bundle;

a steam distrubution duct arranged between the warm tube bundle and the cold tube bundle;

the warm tube bundle being divided into first and second warm tube bundle portions, the first warm tube bundle portion forming a desuperheater bundle and the second warm tube bundle portion forming a condenser bundle; and means for isolating the desuperheater bundle from the condenser bundle.

2. The feed water preheater of claim 1 further comprising:

a condensate drain channel arranged between the first and second warm tube bundle portions.

3. The feed water preheater of claim 1 wherein the means for isolating the desuperheater bundle from the condenser bundle includes at least one support plate.

4. The feed water preheater of claim 1 wherein the cross sectional areas of the desuperheater bundle and the condenser bundle are approximately equal.

5. The feed water preheater of claim 2 further comprising:

a plurality of radial baffle plates; and, collection means for conducting condensate away from the warm tube bundle, the collection means being provided between the condensate drain channel and the radial baffle plates.

6. The feed water preheater of claim 1 wherein the warm and cold tube bundles are U-shaped.

7. The feed water preheater of claim 6 further comprising:

at least one steam inlet arranged perpendicularly with respect to a plane of the U-shaped tube bundles.

8. The feed water preheater of claim 1 wherein the desuperheater tube bundle has a generally rectangular cross section.

* * * * *